United States Patent [19]

Nelson

[11] Patent Number: 4,635,893

[45] Date of Patent: Jan. 13, 1987

[54] ADJUSTABLE SUPPORT FOR A COMPUTER SYSTEM

[76] Inventor: Stephen M. Nelson, 1830 Peace Portal, Blaine, Wash. 98230

[21] Appl. No.: 755,184

[22] Filed: Jul. 15, 1985

[51] Int. Cl.[4] ..... A47B 21/00

[52] U.S. Cl. ..... 248/558; 248/1; 400/718

[58] Field of Search ..... 248/649, 678, 676, 639, 248/371, 455, 456, 460, 1 A-1 F, 558; 400/718, 718.1, 718.2; 312/208

[56] References Cited

U.S. PATENT DOCUMENTS

| | | | |
|---|---|---|---|
| 2,014,176 | 9/1935 | Henderson | 248/456 |
| 4,313,112 | 1/1982 | Foster | 400/682 X |
| 4,483,572 | 11/1984 | Story | 400/682 |

OTHER PUBLICATIONS

"Adjustable Keyboard Shelf"; Inmac Catalog; 39B ed., Aug. 1984.

*Primary Examiner*—J. Franklin Foss
*Assistant Examiner*—David L. Talbott
*Attorney, Agent, or Firm*—Hughes & Cassidy

[57] ABSTRACT

An adjustable structure for supporting a computer keyboard, computer video display and copy material on an elevated surface, such as a tabletop. The computer video display is supported on an adjustable planar portion which rests upon the elevated surface, and which is pivotally connected to a base portion to permit the base portion to be raised above the desk. The base portion includes an upper portion and a lower portion. Extending from the base lower portion is a planar member for supporting the computer keyboard below the level of the desk at a convenient height for operator manipulation. The base upper portion includes an inclined member pivotally connected thereto for supporting the copy materials at selected levels of inclination. The inclined member is supported by a stand which is pivotally engaged to the base upper portion, and which also may be rotated downwardly to engage the elevated surface to support the base portion above the elevated surface. The adjustable planar portion is pivotally connected to the base portion at selected longitudinal locations along the base portion to selectively vary the distance between the keyboard support member and the adjustable portion to accommodate the desires of the operator.

19 Claims, 7 Drawing Figures

FIG. 3
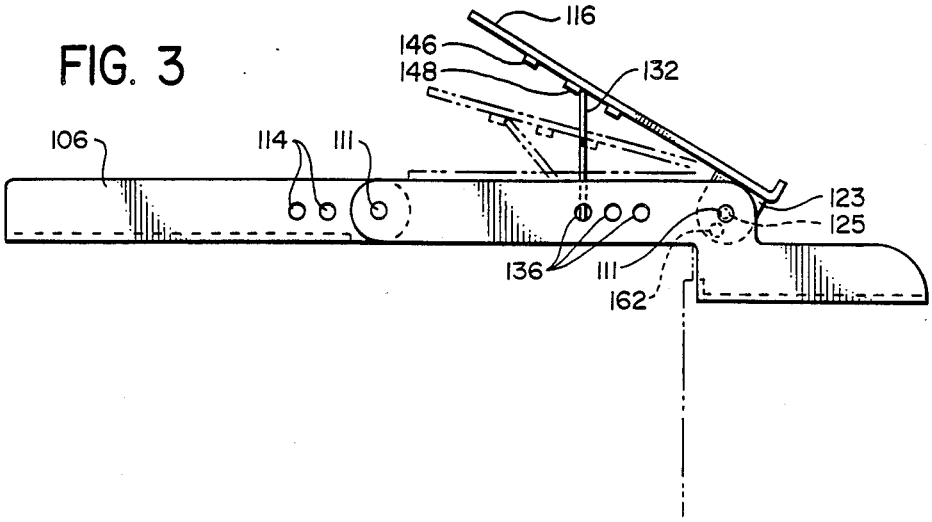
FIG. 4A
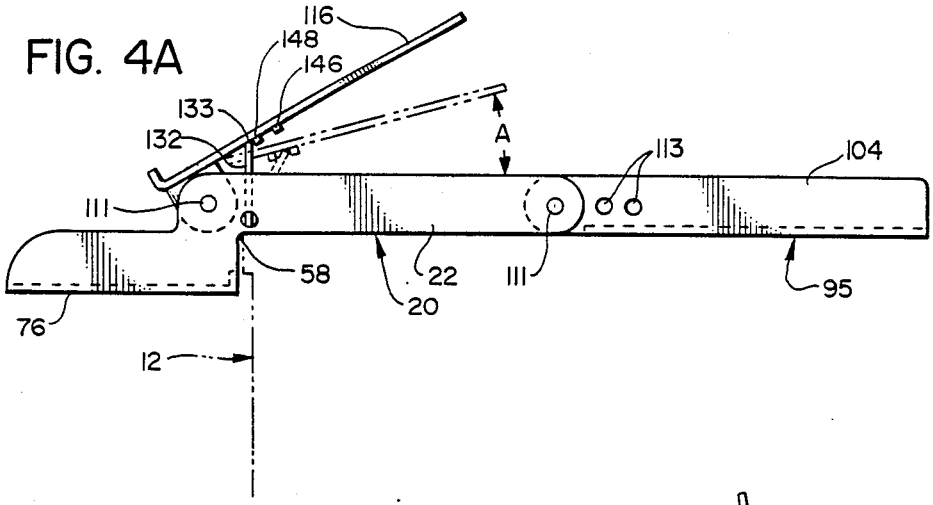
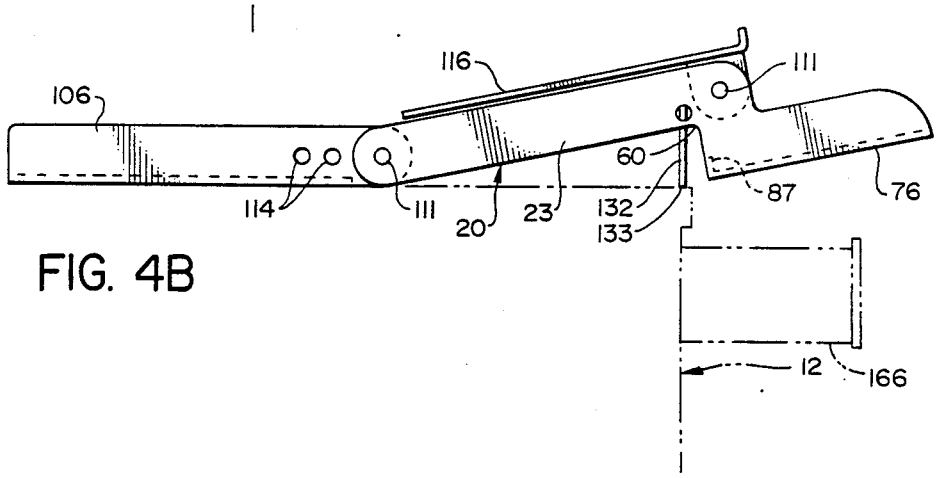
FIG. 4B

ADJUSTABLE SUPPORT FOR A COMPUTER SYSTEM

TECHNICAL FIELD

The present invention relates to a supporting structure for a computer video display, computer keyboard, and associated copy material wherein the supporting structure is utilized on an elevated surface such as a desktop, and has elements which are adjustable to regulate the positions of the video display, keyboard and copy material.

BACKGROUND OF THE INVENTION

Due to the rapid proliferation of computer terminals, particularly in the working environment, efforts have been made to locate the various components of a computer system in a comfortable and convenient manner for use by an operator. Typically, the computer keyboard and screen are stationed on a table or desk with little regard as to the optimum location of the keyboard and the screen relative to the operator for (i) manipulation of the keys of the keyboard, (ii) for viewing the display screen, and (iii) for viewing copy material while entering data from the copy material. Typically, the operator sits in a chair forward of the keyboard and enters data read from copy material by manipulation of the keyboard. The data entered via the keyboard is displayed on a video screen. Operator preferences vary with regard to the locations of the copy material and video screen relative to the operator. In order to accommodate the preferences of different operators, it is desirable that the components of the computer be supported in a manner that allows the video screen and copy material to be easily repositioned in accordance with the operator's desires.

Typically, computer display terminals are embodied in two different configurations. In one configuration, the keyboard and the computer electronics are enclosed in a single housing having a planar upper surface. The housing is typically located behind the keyboard and supports the computer video display on the planar upper surface. The height of the computer, as well as its distance from the keyboard, is dictated by the dimensions of the housing. In another configuration, the keyboard, electronics housing and video display are separate units. The configuration allows for somewhat more flexibility when locating the various components at an operator work station. An interface conduit interconnects the keyboard, screen and associated electronics for interaction therebetween.

In order to assist the computer operator by orienting the work station components at convenient and comfortable locations relative to the operator, various types of conventional support devices have been disclosed.

For example, in U.S. Pat. No. 4,496,200—Hagstrom, et al, there is disclosed a computer display terminal having a keyboard mounted on a movable front portion of the terminal which may be repositioned in a vertical direction over an edge of a desk supporting the terminal to a desired height relative to the desk.

In U.S. Pat. No. 4,483,572—Story, a console is disclosed for a video display unit including a housing having an upper flat surface for supporting a computer screen, and an inner area for storing a platform slideably engaged to the housing for movement to an exposed position outside of and below the housing to support a computer keyboard thereon.

In U.S. Pat. No. 4,428,631—Cope, et al, there is disclosed a computer keyboard work station structure including: a base supporting a computer display screen platform which is adjustable both in a vertical direction and in an inclined direction; a keyboard platform horizontally mounted forward of the screen platform; and a copy support mounting plate mounted slideably to a support between the keyboard platform and the screen platform for vertical movement relative thereto in order to allow the vertical repositioning of the copy support.

Tellier, et al, U.S. Pat. No. 4,365,561, discloses a computer terminal station including a vertical support slideably engaged to a base for vertical slideable movement relative to the base and for rotation about a longitudinal axis of the base relative to the stand, and a platform at the top of the vertical support which may be tilted to selected inclinations with respect to a horizontal plane through the top of the vertical support.

In U.S. Pat. No. 4,316,082—Fritz, a computer console is disclosed having a platform for a keyboard which is slideably mounted to the console to allow movement of the platform between a retracted position below an upper surface of the console and an operable position in front of the console in substantial alignment with the upper surface of the console.

In U.S. Pat. No. 4,313,112—Foster, there is disclosed a computer work station assembly including a first horizontal support surface for supporting a computer keyboard, a platform section defining a second horizontal support for supporting a computer display, and an inclined section for supporting copy materials.

In U.S. Pat. No. 4,109,889—Durket, there is disclosed a book holder having a bottom surface and a back portion extending upwardly from the bottom surface, and adapted for mounting to a desk edge to permit pivotal movement of the book holder relative to the desk between a stored position below the desk and an operable position above the desk.

In U.S. Pat. No. 3,778,125—Gutman, Jr., et al, there is disclosed a worktable having a table portion and a console for supporting one or more keyboards wherein the console is slideably engaged to the table for vertical movement to selected positions relative to the table.

In U.S. Pat. No. 3,696,760—Riley, a classroom table is provided including a main table portion and a plurality of individual inclined desk surfaces slideably engaged to the main table portion for horizontal slideable movement, and including means for adjusting the vertical height of each inclined desk surface.

In U.S. Pat. No. 2,935,209—Fritz, a child's feeding tray adaptable is described for attachment to a tabletop by means of an L-shaped clamp engaged to a downwardly depending portion of the tray wherein the L-shaped clamp engages the edge of the table and the underside of the table to secure the tray to the table.

In U.S. Pat. No. 2,306,209—Elofson, et al, there is disclosed a desk and a support carriage for a calculating machine wherein the support carriage is slideably engaged to a rail assembly mounted to the top of the desk to allow movement of the carriage and the calculating machine to a desired position nearer to or farther from the front of the desk.

In U.S. Pat. No. 2,090,176—Besancon, there is disclosed a counter tray adapted to be attached to an edge of a table wherein the tray includes a forwardly extending portion for supporting articles thereon and a rearwardly extending recess defined by a rearwardly extending lower member, a vertical member and a rearwardly extending spring lip, which is adapted to fit around the edge of the table to support the tray therefrom.

Many of the conventional computer support apparatus are concerned with relatively complex means for adjusting the level of the keyboard to a height selected by the operator. Some of the conventional apparatus provide a support for copy materials which is located at a fixed angle, or which is adjustable by means of apparatus which are relatively complex and cumbersome to use. In addition many of the conventional apparatus lack means for adjusting the distance between the operator and a video screen to correspond to the focal characteristics of the operator's eyes.

Therefore, it is desirable to provide a support, for a computer system, which is adjustable to vary the inclination of the copy material to a desired angle, as well as to vary the distance between the operator and the video display, and yet which is relatively simple in design and easy to use.

SUMMARY OF THE INVENTION

The present invention comprises an apparatus for supporting a computer system, including a video display, computer keyboard and copy material from an elevated surface such as a tabletop. The apparatus includes a base member adapted to be supported on the elevated surface and having a flange portion which extends downwardly below the elevated surface when the base is supported on the elevated surface. The apparatus also includes a first planar member, for supporting the keyboard, which extends forwardly from the flange portion. The first planar member is adapted to be positioned below the elevated surface. The apparatus also includes an adjustable member having a planar portion for supporting the computer video display thereon. The adjustable member is adapted to be supported on the elevated surface, and is engaged to the base member and extends rearwardly therefrom for slideable movement relative to the base member in a forward direction toward the base member and a rearward direction away from the base member. The apparatus also includes means for securing the adjustable member to the base member to position the planar portion at selected predetermined distances from the first planar member. Also included is an inclined member, operatively connected to the base member rearward of the first planar member, for supporting the copy material thereon.

In an exemplary embodiment, the securing means includes means for pivotally connecting the adjusting means to the base means about a first pivot axis to permit movement of the base member between a first position wherein the base member is supported on the elevated surface, and a second position wherein the base member is located above the elevated surface.

In another exemplary embodiment, the inclined member includes a lower portion pivotally connected to the base member at a first pivot location about a second pivot axis, parallel to the first pivot axis, for pivotal movement of the inclined member about the second pivot axis to selected levels of inclination.

In another exemplary embodiment, the apparatus also includes a stand member pivotally connected to the base member at a second pivot location for pivotal movement about a third pivot axis, parallel to the first pivot axis, so that the stand member is pivotable (i) in a first direction to a location above the base member to engage the inclined member and to support the inclined member at the selected levels of inclination, and (ii) in a second direction to a location below the base member to engage the elevated surface and to support the base member above the elevated surface. The inclined member also includes a lower surface having a plurality of receptacles located longitudinally along the lower surface for engaging a support member in order to support the inclined member at the selected angle of inclination. The inclined member lower portion is adapted to be pivotally connected to the base member at any of a plurality of pivot connecting locations located rearward of the first pivot location in order to vary the angle of inclination when supported by the stand member.

In another exemplary embodiment the present invention comprises apparatus for supporting a computer system, including a video display and copy materials, from an elevated surface, such as a desk. The apparatus of the present embodiment includes a base member adapted to be supported on the elevated surface, and an adjustable including a planar portion for supporting the computer video thereon. The adjustable member is adapted to be supported on the elevated surface, and is engaged to the base member and extends rearwardly from the base member for slidable movement relative to the base member in a forward direction towards the base member and a rearward direction away from the base member. Also included are means for securing the adjustable member to the base member to position the planar member at selected distances from the base member. In addition, there is an inclined member, operatively connected to the base member, for supporting the copy material thereon.

It is therefore an object of the present invention to provide a support for a computer system which supports the various computer system components such as a computer keyboard, video screen and copy materials, and which is adjustable to permit selecting (i) the angle of inclination of the copy materials, (ii) the distance between the operator and the video screen, and (iii) the height of the video display.

BRIEF DESCRIPTION OF THE DRAWINGS

These and other objects and advantages of the present invention will become more readily apparent upon reading the following detailed description and upon reference to the attached drawings in which:

FIG. 3 is a side view of the exemplary embodiment shown in FIG. 1, absent the computer keyboard, video screen, component housing and associated copy material, and taken at a left side of the computer support when viewing the computer support from the forward end;

FIGS. 4A and 4B are side views of a second exemplary embodiment of the present invention wherein FIG. 4A is taken at a right side of the computer support when viewing the computer support from the forward end and shows a pivotable support member for supporting a copy support platform at a desired inclination, and FIG. 4B is taken at a left side of the computer support when viewing the computer support from the forward end, and shows the support member pivoted to a six o'clock position for supporting a portion of the computer support above the surface of a desk;

Figure 1:
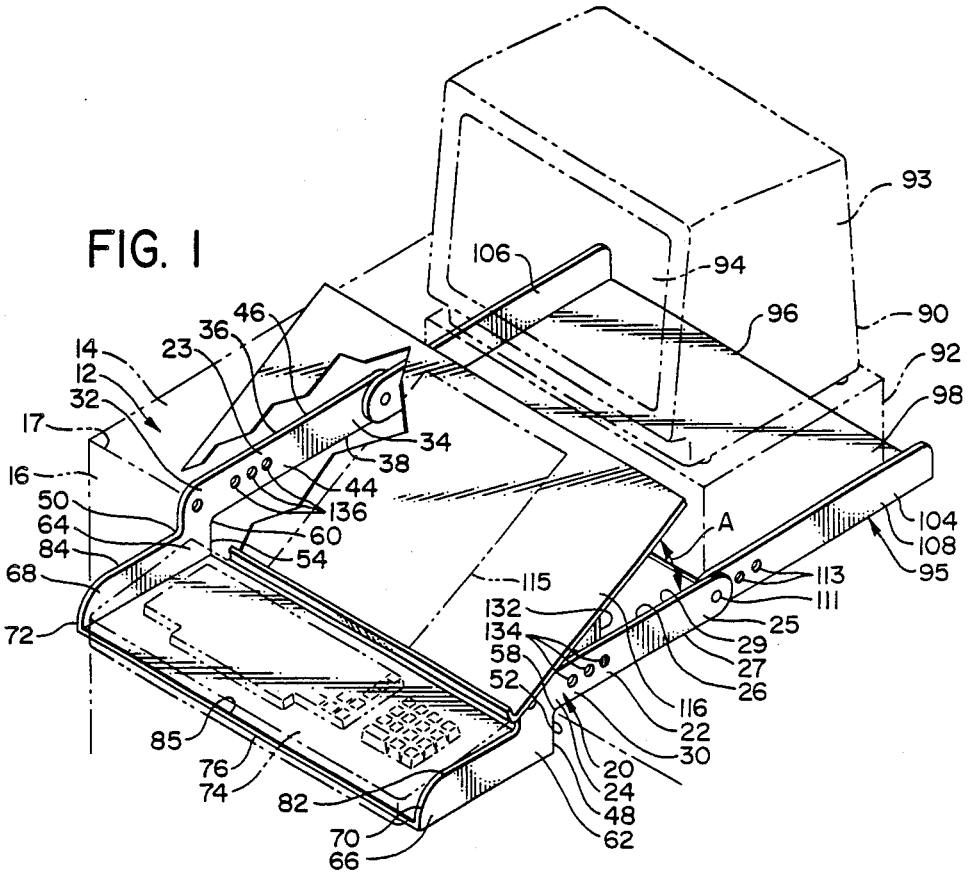
FIG. 1 is an isometric view of a computer support of the present invention, which is supported on an elevated surface, shown in phantom, and which supports a computer keyboard, video screen, electronic component housing and associated copy materials also shown in phantom.

While the present invention is susceptible of various modifications and alternative forms, specific embodiments thereof have been shown by way of example in the drawings and will herein be described in detail. It should be understood, however, that it is not intended to limit the invention to the particular forms disclosed, but on the contrary the intention is to cover all modifications, equivalents and alternatives falling within the spirit and scope of the invention as expressed in the appended claims.

DETAILED DESCRIPTION OF THE INVENTION

Figure 2:
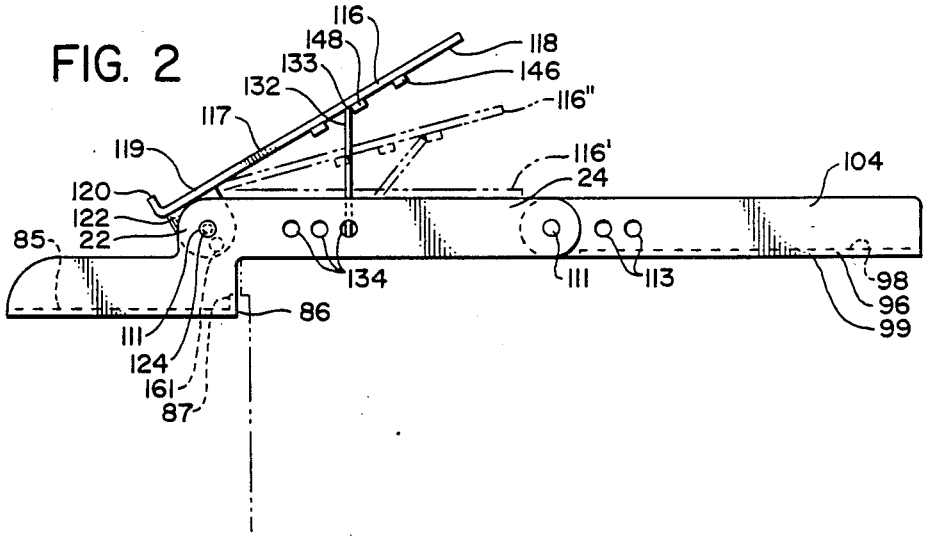
FIG. 2 is a side view of the exemplary embodiment shown in FIG. 1, absent the computer keyboard, video screen, component housing and copy material, and taken from the right side when viewing the computer support from a forward end.

Referring to FIGS. 1, 2 and 3, there is shown a support structure, generally indicated at 10, for supporting various components of a computer system at a work station indicated generally at 12. The work station 12 includes an elevated surface 14 and side portions 16 extending downwardly therefrom at edge 17 to a floor (not shown). Computer support 10 includes a base section indicated at 20 having right and left spaced parallel side rails 22, 23 wherein side rails 22, 23 extend in a fore and aft longitudinal direction. Hereinafter, the terms "longitudinal" and "lateral" will be used to describe the relationship of various elements of computer support structure 10 wherein the longitudinal direction is defined as a direction generally parallel to side rails 22, 23, and the lateral direction is defined as a direction generally perpendicular to side rails 22, 23. Side rail 22 includes a forward portion 24, a rear portion 25, an upper flat surface 26, and a lower flat surface 27 which rests upon elevated surface 14. Side rail 22 also includes inner, outer vertical side surfaces 29, 30, respectively, extending between upper surface 26 and lower surface 27. Likewise, side rail 23 includes a forward portion 32, a rear portion 34, an upper flat surface 36, and a lower flat surface 38 which rests upon elevated surface 14. Side rail 23 also includes inner, outer side surfaces 44, 46 which extend vertically between upper surface 36 and lower surface 38. Extending integrally downward from side rails 22, 23 at forward portions 24, 32, respectively are vertical side rails 48, 50, respectively, having rear surfaces 52, 54, respectively, which join with lower surfaces 27, 38, respectively, to define corners 58, 60, respectively. Corners 58, 60 are adapted to receive edge 17 of work station 12, therein to restrain movement of computer support structure 10 in a longitudinal direction across elevated surface 14. Vertical side rails 48, 50 terminate at ends 62, 64, respectively, where they integrally join with support side rails 66, 68 extending forwardly from ends 62, 64, respectively, in a direction away from rear portions 25, 34, parallel to side rails 22, 23 and terminating at ends 70, 72, respectively.

In order to support a computer keyboard 74, a planar member 76 extends laterally between and is integrally joined to support side rails 66, 68 below elevated surface 14. Planar member 76 is located below upper surfaces 82, 84 of support rails 66, 68, respectively, to restrain lateral movement of keyboard 74 beyond side support rails 66, 68. Extending upwardly from an upper surface 85 of planar member 76 and laterally between side rails 66, 68 at a rear laterally extending edge 86 is a lip portion 87 to prevent rearward movement of computer keyboard 74 beyond planar member 76 when base portion 20 is pivoted to an "upward" position to be described later.

In order to support a housing 92 for enclosing electronic components for operating the computer system, and a video display 93 having a screen 94, computer support 10 includes an adjustable support assembly generally indicated at 95, including a planar member 96 having an upper surface 98 for supporting housing 92 and display 93 thereon, and a lower surface 99 which rests on elevated surface 14. Adjustable support assembly 95 includes parallel side rails 104, 106 integrally joined to planar member 96 at opposite sides thereof and extending vertically upward from upper surface 98 of planar member 96.

Adjustable support assembly 95 may be moved relative to base 20 in order to adjust the distance between screen 94 and an operator, typically seated forward of and proximate to keyboard support 76. Side rails 104, 106 slide in a longitudinal direction within inner surfaces 29, 34 of side rails 22, 23 when adjustable support assembly 95 is moved in a forward longitudinal direction toward keyboard support member 76 and a rearward longitudinal direction away from keyboard support member 76.

In order to secure adjustable support assembly 95 to support base 20 at predetermined selected distances from keyboard support member 76, each side rail 22, 23 includes a first pivot opening (not shown) which extends laterally through side rails 22, 23, respectively, at rear portions 25, 26, respectively, midway between surfaces 26, 27 and surfaces 38, 46, respectively, to align with any one of a plurality of openings 113, 114, respectively, disposed longitudinally along side rails 104, 106 and which extend laterally therethrough. Support assembly 95 is secured to base 20 by fasteners 111. Each fastener 111 has a shaft portion (not shown) extending between an integrally flanged head, and a removable flanged threaded portion. The shaft portions are engaged within the side rail pivot openings and openings 113 or openings 114 laterally aligned with the pivot openings, to permit pivotal movement of support base 20 about a lateral pivot axis formed by the lateral extending shaft portions. It should be appreciated that the present invention encompasses an embodiment wherein a plurality of openings (not shown) are located longitudinally along side rails 22, 23 which laterally align with pivot openings through side rails 104, 106, respectively, for receiving fasteners 111 therein.

Figure 6:
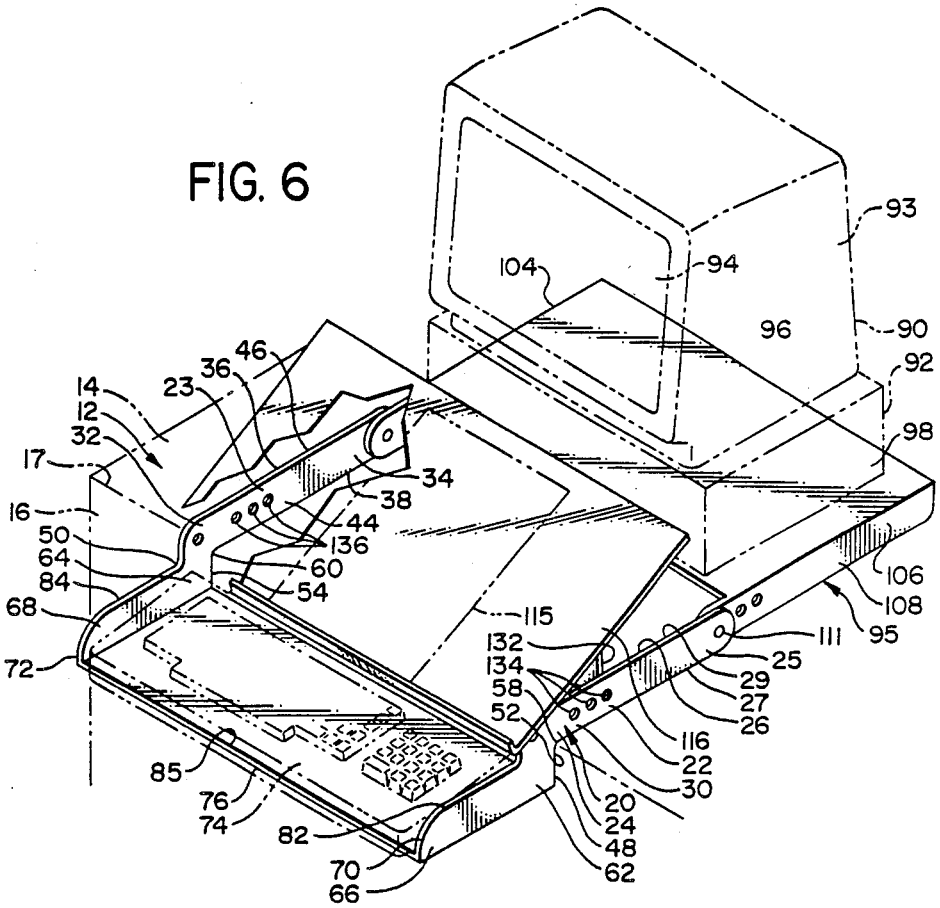
FIG. 6 is an isometric view of another exemplary embodiment of the present invention wherein the adjustable support assembly is placed in an inverted position so as to elevate the video display.

As shown in FIG. 6, in order to adjust the height of video display 93 above elevated surface 14, adjustable support assembly 95 may be inverted so that planar member 96 is supported above elevated surface 14 by side rails 104, 106 at a height equal to the vertical distances between the upper and lower surfaces of side rails 104, 106, respectively. Openings 113, 114 of side rails 104, 106, respectively, are located midway between the upper and lower surfaces thereof in order to laterally align with the first pivot openings of side rails 22, 23, respectively, when support assembly 95 is in the "inverted" position.

In order to support a copy material 115 which is read by an operator when entering data into the computer system via keyboard 74, computer support 10 includes a copy platform 116 extending laterally outboard of side rails 22, 23 and having an upper surface 117, a lower surface 118 and a lower portion 119. In order to prevent copy materials 114 from sliding off upper surface 117, a lip 120 extends integrally perpendicularly from upper surface 117 of bottom portion 119 and laterally across copy support platform 116. Extending downwardly from lower surface 118 at lower portion 119 is (i) a first planar flange 122 located parallel and adjacent to inner surface 29 of support rail 22, and (ii) a second planar flange 123 located parallel and adjacent to inner surface 34 of side rail 23. Flanges 122, 123 include laterally extending openings 124, 125, respectively, which align with laterally extending second openings (not shown) of side rails 22, 23 at side rail forward portions 24, 32, respectively, in order to receive fasteners 111 therein. Fasteners 111 engage side rails 22, 23 and flanges 122, 123 to permit pivotal movement of copy support platform 116 about pivot fasteners 111 between a "retracted" position, shown in phantom in FIG. 2, corresponding to the position of a copy support 116', and wherein lower surface 118 rests upon upper surfaces 26, 36; and an "extended" position wherein copy platform 116 is rotated in a counterclockwise direction, when viewing FIG. 2, through an "intermediate" inclined position indicated at 116''. Each of the inclined positions is defined by an acute angle A formed by the intersection of a first imaginary plane extending forwardly from upper surface 117 and a second imaginary plane extending forwardly from side rail upper surfaces 26, 36.

In an exemplary embodiment shown in FIG. 2, computer support 10 includes a support stand 132 for supporting copy platform 116 in the "intermediate" inclined position, shown in phantom, and corresponding to the position of a copy support 116''; and the "elevated" inclined position corresponding to the "solid line" position of copy support 116. Support stand 132 has a rectangular planar configuration including a first laterally extending edge 133 and a parallel second laterally extending edge (not shown). Support stand 132 includes integral pin members (not shown) projecting laterally therefrom proximate to the second laterally extending edge of support stand 132 to pivotally engage any of a plurality of openings 134, 136 located longitudinally along side rails 22, 23. Computer support 10, including support stand 132, is preferably fabricated from an acrylic material which allows support 132 to be resiliently bent in order to insert the pin members into a selected pair of openings 134, 136.

In an alternate embodiment, support stand 132 includes an elongated member (not shown) extending laterally between side rails 22, 23 and integrally joined thereto proximate to lower surfaces 27, 38, respectively. A rectangular planar shaped member (not shown) is then pivotally connected to the elongated member by hinges, having laterally extending pivot axes, joined to a lengthwise edge of the rectangular member, which support copy platform 116 in the various inclines positions described previously.

In order to engage support stand 132, copy support platform 116 includes a first pair of knob-like members 146 located laterally across lower surface 120 of copy support platform 116, and a second pair of knob-like members 148 located laterally across lower surface 120 between knob member 146 and flanges 122, 123. Knob members 146, 148 are located rearward of openings 134, 136 when viewing copy support 116 in the "retracted" position, in order to provide the desired inclination of copy support platform 116. Knob members 146, 148, together with lower surface 120, define crotch-like receptacles for receiving laterally extending edge 133 of support stand 132 therein in order to support copy platform 116 at a desired angle of inclination. It should be appreciated that the angle A of inclination through which copy platform 116 supported by support stand 132 may be varied depending upon which pair of laterally aligned openings 134, 136 the pin members of support stand 132 are engaged within.

In order to provide additional space between flanges 122, 123 and keyboard support platform 76 to accommodate keyboards 74 having different vertical heights, flanges 122, 123 include laterally extending openings 161, 162 located radially outward from flange openings 124, 125. By pivotally engaging flanges 122, 123 to openings 161, 162, respectively, with fasteners 111, flanges 122, 123 are relocated upwardly away from keyboard support platform 76.

As discussed previously, keyboard platform 76 extends below elevated surface 14 adjacent to side portion 16. It is not uncommon, as shown in FIG. 4B, for work station 12 to comprise a desk or the like having one or more drawers 166 which may be located behind keyboard platform 76 thereby blocking the access of an operator to drawer 166. In some conventional computer supports, access to drawer 166 requires movement of the entire computer support in addition to the computer keyboard, as well as the heavier components comprising the computer video display and electronic component housing. In an exemplary embodiment illustrated in FIGS. 4A and 4B, which incorporates identical elements as those described with reference to FIGS. 1–3, computer base portion 20 is pivotally connected to adjustable support assembly 95 so that base portion 20 and the computer keyboard supported thereon, may be rotated relative to adjustable support assembly 95 in a counterclockwise direction, when viewing FIG. 4, upwardly from drawer 166 to a "raised" position to permit access to drawer 166. In order to free the operator from holding support base 20 in the "raised" position, support stand 132 is pivotally connected to side rails 22, 23 proximate to corners 58, 60 in a manner described previously. Therefore, when support base 20 is elevated to the "raised" position, as shown in FIG. 4B, support stand 132 is pivoted to a six o'clock position where edge 133 engages elevated surface 14 to support base 20 in the "raised" position. In the "raised" position, computer keyboard 74 is restricted from sliding rearwardly off of keyboard support platform 76 by engagement with lip 87. When base portion 20 is in a "lowered" position resting on elevated surface 14, support stand 132 may be utilized as previously described with reference to FIGS. 1 through 3 to support copy platform 116 at various selected angles of inclination.

Figure 5:
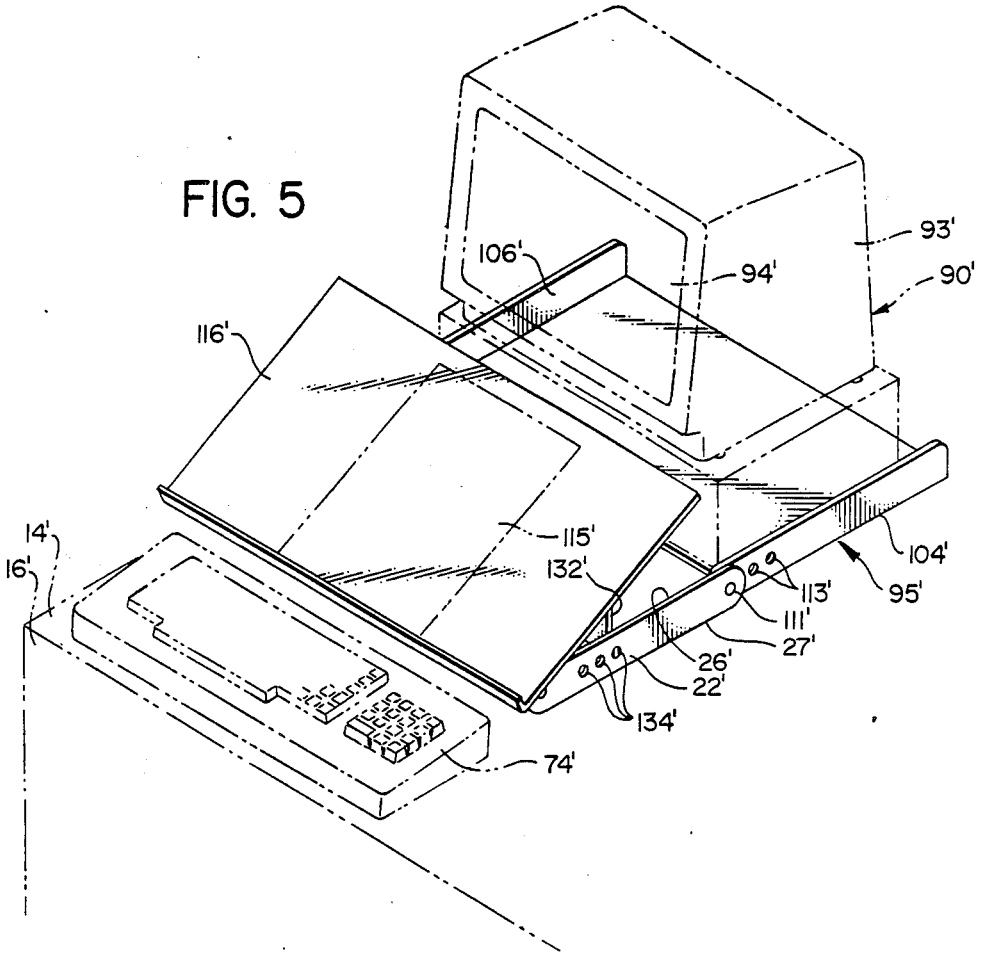
FIG. 5 is an isometric view of a third exemplary embodiment showing a computer support which is supported on an elevated surface, shown in phantom, and which supports a video screen, electronic component housing, and associated copy materials also shown in phantom

In another exemplary embodiment shown in FIG. 5 wherein elements shown in FIGS. 1 through 4 are designated by like reference numerals with a prime (') symbol, there is shown computer support 10' absent keyboard support planar member 76, as well as support side rails 66, 68 and vertical side rails 48, 50. In the present embodiment keyboard 74' is supported on elevated surface 14' forward of lip 120' of copy platform 116'. Therefore, computer support 10' may be positioned at any desired location on elevated surface 14'.

Other embodiments not disclosed herein, but which are encompassed within the spirit and scope of the present invention as described herein are also included as part of the present application.

What is claimed is:

1. Apparatus for supporting a computer system, including a video display, computer keyboard and copy materials, from an elevated surface, comprising:

a. a base member, adapted to be supported on said elevated surface, and including first and second elongated upstanding side members, and having a flange portion which extends downwardly below said elevated surface when said base member is supported on said elevated surface;

b. a first planar member, for supporting said keyboard thereon, extending forwardly from said flange portion at a location below said elevated surface;

c. an adjustable member, including a planar portion for supporting said computer video display thereon, and first and second upstanding side members which are connected to said planar portion so that said first and second side members of said adjustable member are located generally adjacent to the respective first and second side members of said base member, said adjustable member being characterized in that said adjustable member (i) is adapted to be supported on said elevated surface, and (ii) is engaged to said base member and extends rearwardly therefrom for slidable movement on said elevated surface relative to said base member in a forward direction toward said base member and a rearward direction away from said base member;

d. means for securing said adjustable member to said base member to position said planar portion at selected distances from said first planar member, said securing means including (i) first fastening means which releasably connect said first side member of said base member to said first side member of said adjustable member, and (ii) second fastening means which releasably connect said second side member of said base member to said second side member of said adjustable member; and e. an inclined member, operatively connected to said base member rearward of said first planar member, for supporting said copy material thereon.

2. The apparatus as set forth in claim 1 wherein said securing means includes means for pivotally connecting said adjustable member to said base member about a first pivot axis to permit movement of said base member between a first position where said base member is supported on said elevated surface, and a second position where said base member is located above said elevated surface.

3. The apparatus as set forth in claim 1 wherein said inclined member includes a lower portion pivotally connected to said base member at a first pivot location about a second pivot axis, parallel to said first pivot axis, for pivotal movement of said inclined member about said second pivot axis to selected levels of inclination.

4. The apparatus as set forth in claim 3 additionally comprising a stand member pivotally connected to said base member at a second pivot location for pivotal movement about a third pivot axis, parallel to said first pivot axis, so that said stand member is pivotable (i) in a first direction to a location above said base member to engage said inclined member and to support said inclined member at said selected levels of inclination, and (ii) in a second direction to a location below said base member to engage said elevated surface and to support said base member above said elevated surface.

5. The apparatus as set forth in claim 4 wherein a. said inclined member includes a lower surface having a plurality of receptacles located longitudinally along said lower surface for engaging said stand member in order to support said inclined member at said angle of inclination; and b. said stand member is adapted to be pivotally connected to said base member at any of a plurality of pivot connecting locations located rearward of said first pivot location in order to vary said angle of inclination when supported by said stand member.

6. The apparatus as set forth in claim 5 wherein said securing means comprises:

a. a plurality of laterally extending first openings located longitudinally along said adjustable member; and b. a laterally extending second opening in said base member; and c. a removable pivot shaft extending laterally through at least one of said first openings and said second opening.

7. The apparatus as set forth in claim 5 wherein said securing means comprises:

a. a plurality of laterally extending first openings located longitudinally along said base member; and b. a laterally extending second opening in said adjustable member; and c. a removable pivot shaft extending through at least one of said first openings and said second opening.

8. The apparatus as set forth in claim 1 wherein:

a. said first and second side members of said adjustable member extend vertically from said planar portion and terminate at respective top edges at a selected distance from said planar portion; and b. said adjustable member is removably connected to said base member to permit inversion of said adjustable member between a first support position where said planar portion is supported on said elevated surface to permit viewing of said video display at a first elevation, and a second support position where said side member top edges are supported on said elevated surface in order to support said video display on said planar portion at a distance above said elevated surface which is substantially equal to said selected distance so as to raise said video display for viewing at a second elevation.

9. The apparatus as set forth in claim 1 wherein said first and second fastening means each include a fastener member having a shaft portion for connecting said adjustable member to said base member.

10. The apparatus as set forth in claim 9 wherein said shaft portion extends through adjacent openings in said side members of said base member and said adjustable member.

11. Apparatus for supporting a computer system, including a video display and copy materials, from an elevated surface, comprising:

a. a base member adapted to be supported on said elevated surface, and including first and second upstanding side members;

b. an adjustable member, including a planar portion for supporting said computer video display thereon, and further including first and second upstanding side members which are connected to said planar portion so that said first and second side members of said adjustable member are generally adjacent to said respective first and second side members of said base member, said adjustable member is characterized in that said adjustable member (i) is adapted to be supported on said elevated surface, (ii) is engaged to said base member and extends rearwardly therefrom for slidable movement relative to said base member in a forward direction toward said base member and a rearward direction away from said base member;

c. means for securing said adjustable member to said base member to position said planar portion at selected distances from said base member, said securing means including (i) first fastening means which releasably connect said first side member of said base member to said first side member of said adjustable member, and (ii) second fastening means which releasably connect said second side member of said base member to said second side member of said adjustable member; and d. an inclined member, operatively connected to said base member, for supporting said copy material thereon.

12. The apparatus as set forth in claim 11 wherein said securing means includes means for pivotally connecting said adjustable member to said base member about a first pivot axis to permit movement of said base member between a first position wherein said base member is supported on said elevated surface, and a second position wherein said base member is located above said elevated surface.

13. The apparatus as set forth in claim 11 wherein said inclined member includes a lower portion pivotally connected to said base member at a first pivot location about a second pivot axis, parallel to said first pivot axis, for pivotal movement of said inclined member about said second pivot axis to selected levels of inclination.

14. The apparatus as set forth in claim 11 wherein:

a. said first and second side members of said adjustable member extend vertically from said planar portion and terminate at respective top edges at a selected distance from said planar portion; and b. said adjustable member is removably connected to said base member to permit inversion of said adjustable member between a first position where said planar portion is supported on said elevated surface to permit viewing of said video display at a first elevation, and a second position where said side member top edges are supported on said elevated surface in order to support said video display on said planar portion at a distance above said elevated surface which is substantially equal to said selected distance so as to raise said video display for viewing at a second elevation.

15. Apparatus for supporting a computer system, including a video display, computer keyboard and copy materials, from an elevated surface, comprising:

a. a base member, adapted to be supported on said elevated surface, and having a flange portion which extends downwardly below said elevated surface when said base member is supported on said elevated surface;

b. a first planar member, for supporting said keyboard thereon, extending forwardly from said flange portion at a location below said elevated surface;

c. an adjustable member, including a planar portion for supporting said computer video display thereon, and characterized in that said adjustable member (i) is adapted to be supported on said elevated surface, and (ii) is engaged to said base member and extends rearwardly therefrom for slidable movement relative to said base member in a forward direction toward said base member and a rearward direction away from said base member;

d. means for securing said adjustable member to said base member to position said planar member, said securing means including means for pivotally connecting said adjustable member to said base member about a first pivot axis to permit movement of said base member between a first position where said base member is supported on said elevated surface, and a second position where said base member is located above said elevated surface; and e. an inclined member, operatively connected to said base member rearward of said first planar member, for supporting said copy material thereon.

16. The apparatus as set forth in claim 15 wherein:

a. said inclined member includes a lower portion pivotally connected to said base member at a first pivot location about a second pivot axis, parallel to said first pivot axis, for pivotal movement of said inclined member about said second pivot axis to selected levels of inclination; and b. said apparatus additionally comprises a stand member pivotally connected to said base member at a second pivot location for pivotal movement about a third pivot axis, parallel to said first pivot axis, so that said stand member is pivotable (i) in a first direction to a location above said base member to engage said inclined member and to support said inclined member at said selected levels of inclination, and (ii) in a second direction to a location below said base member to engage said elevated surface and to support said base member above said elevated surface.

17. Apparatus for supporting a computer system, including a video display, computer keyboard and copy materials, from an elevated surface, comprising:

a. a base member, adapted to be supported on said elevated surface, and having a flange portion which extends downwardly below said elevated surface when said base member is supported on said elevated surface;

b. a first planar member, for supporting said keyboard thereon, extending forwardly from said flange portion at a location below said elevated surface;

c. an adjustable member, including a planar portion for supporting said video computer video display thereon, and further including first and second side members extending upwardly from said planar portion and terminating at respective top edges at a selected distance from said planar portion, said adjustable member characterized in that said adjustable member (i) is adapted to be supported on said elevated surface, and (ii) is engaged to said base member and extends rearwardly therefrom for slidable movement relative to said base member in a forward direction toward said base member and a rearward direction away from said base member;

d. means for securing said adjustable member to said base member, (i) to position said planar portion at selected distances from said first planar member, and (ii) to permit inversion of said adjustable member between a first support position where said planar portion is supported on said elevated surface to permit viewing of said video display at a first elevation, and a second position where said top edges of said side members are supported on said elevated surface in order to support said video display on said planar portion at a distance above said elevated surface which is substantially equal to said selected distance so as to raise said video display for viewing at a second elevation.

18. Apparatus for supporting a computer system, including a video display, computer keyboard and copy materials, from an elevated surface, comprising:

a. a base member, adapted to be supported on said elevated surface, and having a flange portion which extends downwardly below said elevated surface when said base member is supported on said elevated surface;

b. a first planar member, for supporting said keyboard thereon, extending forwardly from said flange portion at a location below said elevated surface;

c. an adjustable member, including a planar portion for supporting said computer video display thereon, and characterized in that said adjustable member (i) is adapted to be supported on said elevated surface, and (ii) is engaged to said base member and extends rearwardly therefrom for slidable movememt relative to said base member in a forward direction towards said base member in a rearward direction away from said base member;

d. means for securing said adjustable member to said base member to position said planar portion at selected distances from said first planar member;

e. an inclined member for supporting said copy material thereon; and f. means for connecting said inclined member to said base member to allow pivotal movement of said inclined member to selected levels of inclination, said connecting means including first and second pivot connectors which connect a lower portion of said inclined member to said base at selected distances of said lower portion above said first planar member.

19. The apparatus as set forth in claim 18 wherein:

a. said base member includes first and second upstanding side members; and b. said pivot connectors include (i) first openings which extend laterally through said first and second side members, (ii) second openings which extend laterally through said first and second side member in a manner that the second openings are located at a greater distance above said first planar member than the first openings, and (iii) first and second pin members which extend laterally from said inclined member and which are adapted to engage either said first openings or said second openings to position said lower portion of said inclined member at a selected distance above said first planar member.

* * * * *